US006318450B1

(12) United States Patent
Acre

(10) Patent No.: US 6,318,450 B1
(45) Date of Patent: Nov. 20, 2001

(54) FASTENER FREE AUTOMOTIVE HEAT EXCHANGER MOUNTING

(75) Inventor: James A Acre, Barker, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/643,345

(22) Filed: Aug. 22, 2000

(51) Int. Cl.[7] ..... F28F 9/00

(52) U.S. Cl. ..... 165/67; 165/149; 165/121; 180/68.4

(58) Field of Search ..... 165/41, 67, 149, 165/121; 180/68.4

(56) References Cited

U.S. PATENT DOCUMENTS

| | | | | |
|---|---|---|---|---|
| 4,541,645 | * | 9/1985 | Foeldesi | 180/68.4 |
| 4,763,723 | * | 8/1988 | Granetzke | 165/67 |
| 5,046,554 | | 9/1991 | Iwasaki et al. | 165/140 |
| 5,139,080 | | 8/1992 | Bolton et al. | 165/67 |
| 5,163,505 | * | 11/1992 | Hoffman et al. | 165/67 |
| 5,219,016 | | 6/1993 | Bolton et al. | 165/41 |
| 5,355,941 | | 10/1994 | Blankenberger et al. | 165/180 |
| 5,649,587 | | 7/1997 | Plant | 165/41 |
| 5,657,817 | * | 8/1997 | Heine et al. | 165/67 |
| 5,667,004 | * | 9/1997 | Kroetsch | 165/41 |
| 5,791,402 | * | 8/1998 | Dumetz | 165/67 |
| 5,829,133 | | 11/1998 | Joshi et al. | 29/890.043 |
| 5,901,786 | | 5/1999 | Patel et al. | 165/283 |

FOREIGN PATENT DOCUMENTS

2304883-A1 * 8/1974 (DE) .

* cited by examiner

*Primary Examiner*—Allen Flanigan
(74) *Attorney, Agent, or Firm*—Patrick M. Griffin

(57) ABSTRACT

An automotive heat exchanger module comprises a radiator and condenser with conventional side manifold tanks and upper and lower, channel shaped reinforcements. Neither heat exchanger has any brackets or other provision for attachment to the vehicle by separate fasteners. Instead, a center mounted fan module has rectangular front and rear openings the upper and lower edges of which comprise integral features within which the upper and lower core reinforcements are captured and held with a simple push fit.

5 Claims, 6 Drawing Sheets

FASTENER FREE AUTOMOTIVE HEAT EXCHANGER MOUNTING

TECHNICAL FIELD

This invention relates to air conditioning and ventilation systems in general, and specifically to a fastener free mounting for automotive heat exchangers.

BACKGROUND OF THE INVENTION

The front end of a typical automotive vehicle contains at least one, and usually a pair of heat exchangers. An engine cooling system radiator, with large, plastic side tanks, is mounted between a pair of structural automotive body side rails, generally isolated therefrom by rubber pads to absorb vibrations. The large molded plastic tanks provide a convenient foundation to which other structure can be fixed, once the radiator itself is fixed in place. At a minimum, a cooling fan support structure is mounted to the rear of the radiator, fastened to the back of the radiator side tanks generally with threaded fasteners. When the vehicle also has an air conditioning system condenser, that is typically mounted to the front of the radiator tanks, in similar fashion, also with separate fasteners. An example of such a mounting scheme may be seen in U.S. Pat. No. 5,139,080. Systems are known in which the number of fasteners is minimized by using integral hooks molded into and onto the radiator tanks, into which special brackets on the condenser and fan support are slide fitted. While the number of fasteners is minimized, the necessity of providing dedicated mounting brackets, especially on heat exchanger tanks, is a considerable expense. Brackets must either be separately welded to a tank, or integrally manufactured with the tank, as part of a continuous extrusion, in which case extra extruded material must be cut away to leave a discrete bracket. Either alternative requires additional manufacturing steps and expense, to create structure that is extraneous to the basic structure of the heat exchanger itself.

A relatively recent trend is the so called modularization of automotive components, in which more and more separate components are integrated into larger structures at the component plant level, which can then be installed more quickly and inexpensively at the assembly plant level. All areas have been affected, including the vehicle "front end". Various front end module designs found in the prior art generally show a basic box like structure, fixed to the front end of the vehicle just behind the front bumper or grill, or even forming an integral part of the front end structure of the vehicle body. The various heat exchangers and fans are shown mounted to or within the "box," but often with no detail as to exactly how the installation would take place. Other designs, such as that shown in U.S. Pat. No. 5,046,554 and co assigned patent application Ser. No. 09/299,504 clearly indicate that the heat exchanger mounting would be basically conventional, that is, using the same dedicated brackets and separate threaded fasteners used to mount heat exchangers in older, non modularized designs.

SUMMARY OF THE INVENTION

The invention provides a system for mounting heat exchangers that requires no separate fasteners and no dedicated brackets or features on the heat exchangers. Instead, the standard structural features of the heat exchangers are used, without modification, in cooperation with special features that are integrally manufactured with and into the basic structural framework of the module itself.

In the preferred embodiment disclosed, a conventional radiator and condenser are manufactured each as a basic four sided frame, with manifold tanks on the sides and core reinforcements at the top and bottom. The core reinforcements are typically elongated metal channels, attached at their left and right ends to the top and bottom ends of the manifold tanks to create a solid, four sided framework. No special brackets or the like are formed on either the manifold tanks or the core reinforcements of either the radiator or the condenser.

The basic module foundation consists of a box like structure within which a cooling fan or fans is contained. The box is formed of one or more sections of molded plastic or composite material, to which it is possible to integrally mold attachment features at both the top and bottom edges at both the front and rear rectangular openings in the module. These coact with the core reinforcements of the heat exchangers to physically attach them without separate fasteners. Specifically, continuous, close fitting troughs are provided at the bottom edges of the module into which the lower core reinforcements of each heat exchanger can be seated. Along the top edges, flexible capture features allow the top core reinforcements to be snap fitted into the module after the bottom reinforcements are seated. The end result is a secure fastening of each heat exchanger to the front and rear of the module. Part count is absolutely minimized, and the system is essentially self sealing as well as easily adaptable to various heat exchanger core widths and depths.

BRIEF DESCRIPTION OF THE DRAWINGS

These and other features of the invention will appear from the following written description, and from the drawings, in which.

DESCRIPTION OF THE PREFERRED EMBODIMENT

Figure 2:
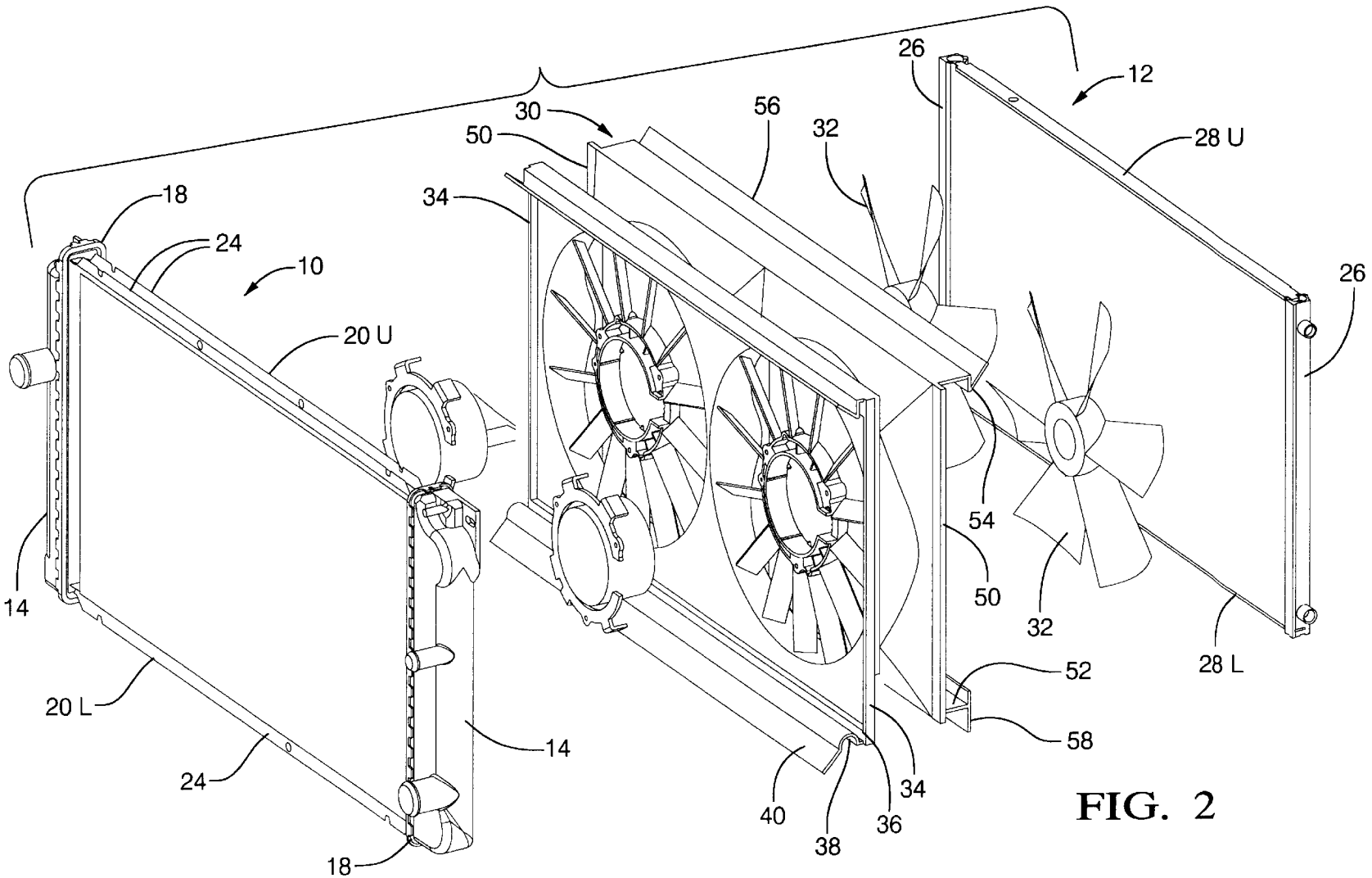
FIG. 2 is a view like FIG. 2, but showing the heat exchangers aligned with the module, prior to installation.

Referring first to FIG. 2, the heat exchangers incorporated in the subject invention are notable more for features that they lack, than those which they possess. Specifically, a radiator 10 and condenser 12 each has the basic, four sided structural framework that is typically found. Radiator 10 has a pair of generally vertical manifold tanks 14, one on each side, which are open sided plastic moldings formed with integral coolant inlets and outlets, as well as other features such as coolant filler necks. These tanks 14 are typically closed by slotted metal header plates 18, to which they are separately crimped, in fluid tight fashion. Before the radiator tanks 14 are crimped in place, the the header plates 18 are fixed to lower and upper core reinforcements, 20L and 20U respectively. The core reinforcements 20L and 20U are stamped metal channels, essentially identical but for location, with two parallel, equal height, upstanding ribs. The ribs 24, in both cases, face outwardly, which is typical for a radiator. The header plates 18 are brazed, or otherwise securely joined, at their top and bottom ends to the ends of the core reinforcements 20L and 20U, forming a solid, four sided core framework. Standard flow tubes and corrugated air fins, not disclosed in detail, are bounded within and protected by this framework. Condenser 12 has a similar basic framework. All metal manifold tanks 26 are brazed or fixed at their upper and lower ends to the ends of lower and upper core reinforcements 28L and 28U, respectively. The core reinforcements 28L and 28U are also stamped metal channels but, unlike those used in the radiator 10, typically face inwardly, as shown. The same solid four sided frame is formed, also bounding and protecting conventional flow tubes and corrugated air fins. As noted above, the distinctive feature of radiator 10 and condenser 12 as disclosed is the complete lack of mounting features on either. That is, the radiator tanks 14 have no integrally molded tabs or features thereon to be used for with separate attachment fasteners, such as bolts or screws. Likewise, the condenser tanks 26 have no attachment brackets or tabs thereon, to serve the same purpose. Only the very "basic" structure of both radiator 10 and condenser 12 is present, and there would appear to be no way provided to install them to a vehicle.

Figure 1:
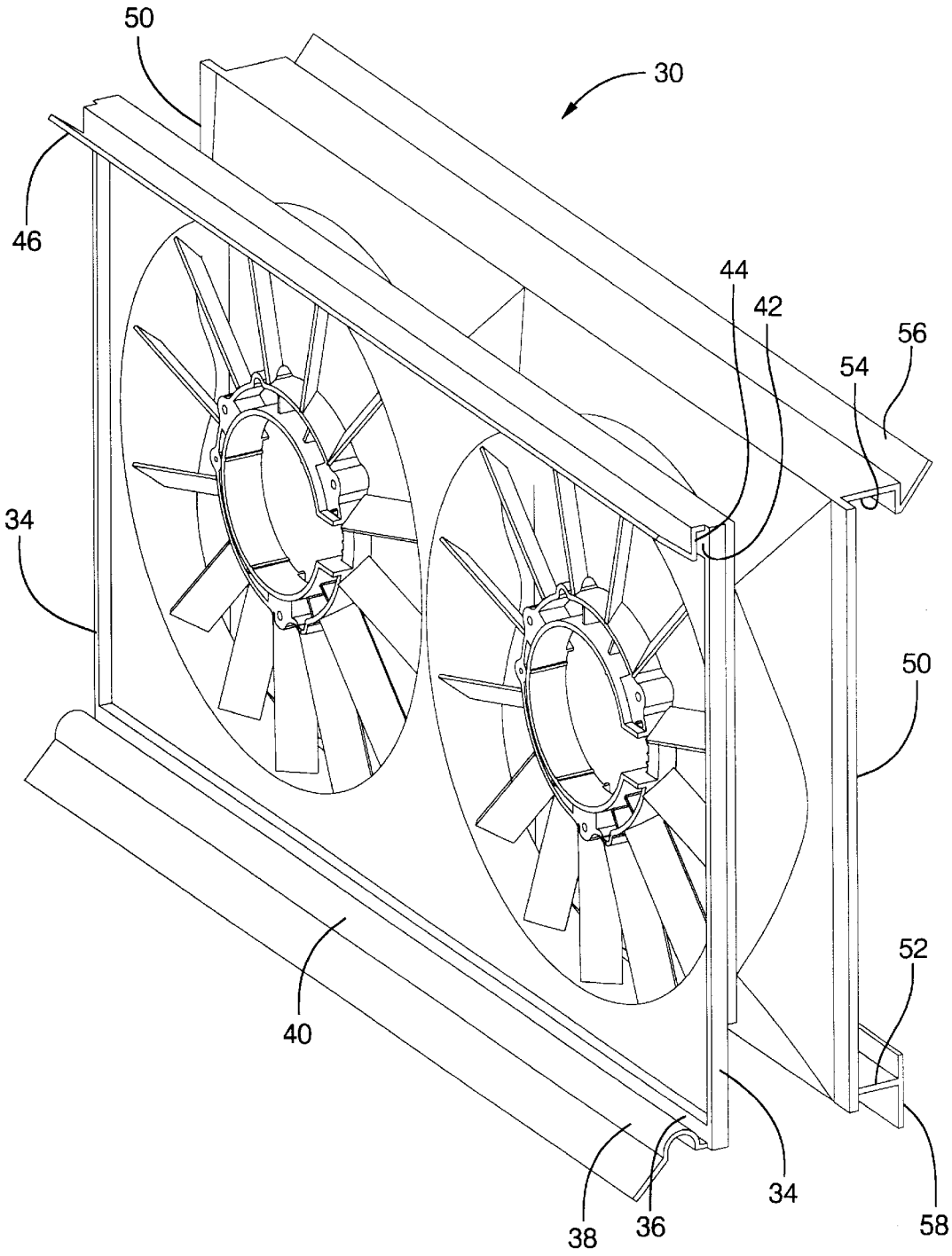
FIG. 1 is a perspective view of the basic module structure, shown from the rear.

Referring next to FIG. 1, the basic module foundation, indicated generally at 30, is a fan shroud, generally hollow and box shaped, with rectangular front and rear, openings arrayed in generally parallel planes. In the embodiment disclosed, a pair of cooling fans 32 is contained in the center of the basic module structure, hence the name fan shroud, but the fans 32 could be mounted elsewhere. It is particularly advantageous to the invention disclosed to so locate the fans 32, however. Shroud 30 is rigid enough to be secured solidly to (or form a solid part of) the front end structure of a vehicle body, but beyond that basic requirement, can be manufactured from a wide variety of materials and methods. Potential materials could be compression molded plastic, blow molded plastic, sheet molded composite, or hybrid metal and plastic structures. It is preferable, however, that the top and bottom edges, at least, of the front and rear openings be molded of a flexible and resilient material, such as compression molded plastic, to best provide the particular mounting features of the invention.

Figure 4:
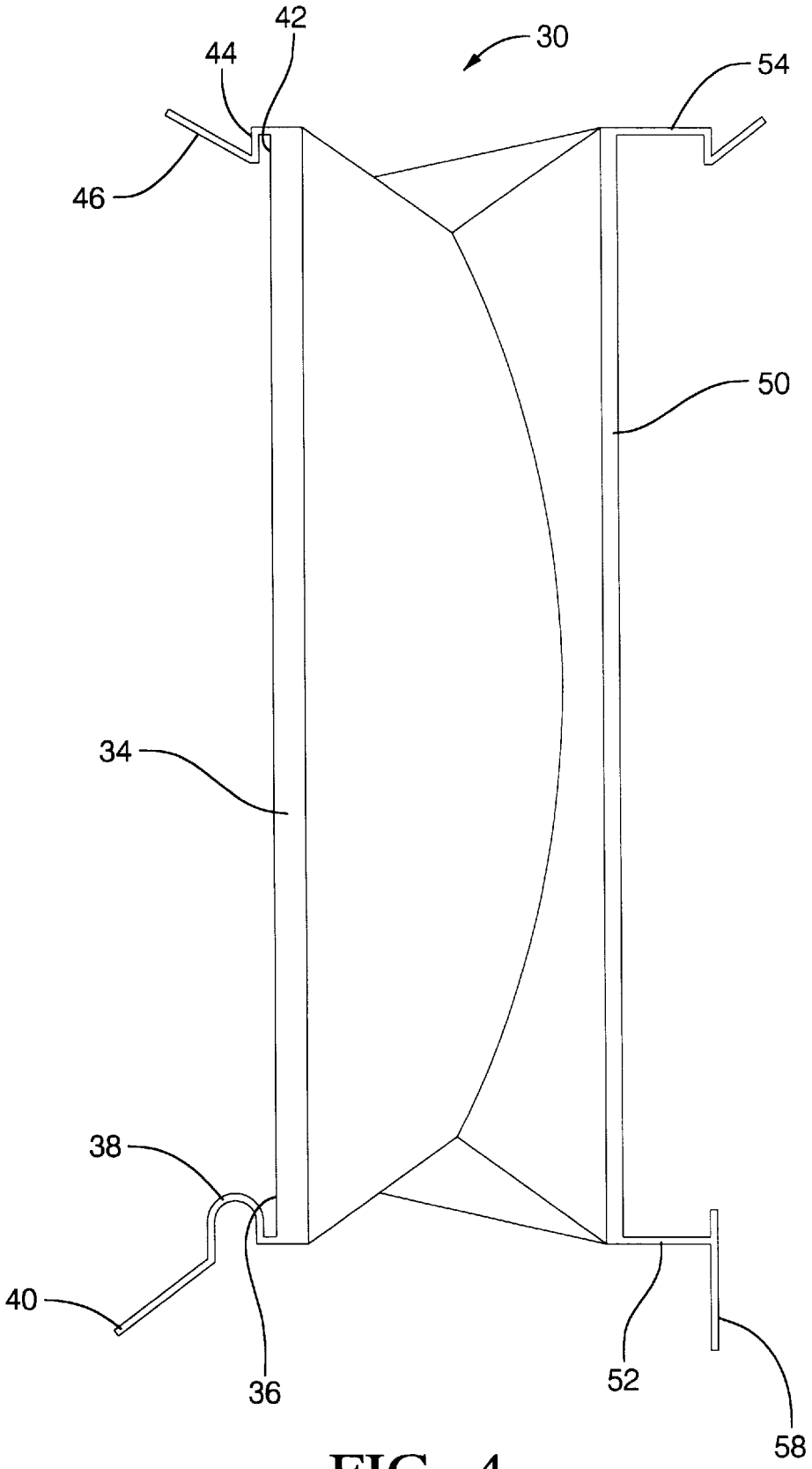
FIG. 4 is a schematic side view of the module showing the relative location of the heat exchanger fastening features prior to installation of the heat exchangers.

Referring next to FIGS. 1 and 4, the details of some of the heat exchanger installation features are illustrated. A generally rectangular, four sided opening at the rear of shroud 30 is defined, in part, by two straight, parallel side edges 34. The side edges 34 are coplanar, and spaced apart by a width that is substantially equal to the spacing of the radiator header plates 18. The lower edge of the rear opening of fan shroud 30 is comprised of two features, a stiff lower mounting wall 36, comparable in height and length to a rib 24 of core reinforcement 20L, and a curved, hollow ridge 38 in front of and parallel to mounting wall 36, which has a width and depth designed to fit closely within and between the upstanding ribs 24 of lower core reinforcement 20L. Both of these features are preferably integrally molded to the lower rear edge of shroud 30, although neither is required to be flexible. The mounting wall 36 and the rear surface of ridge 38 are spaced apart only by the thickness of a reinforcement rib 24, forming what could be considered a very narrow trough, and the mounting wall 36 is located just outboard of the plane formed by the side edges 34. In the embodiment disclosed, a downwardly sloping air control blade 40 is integrally molded to the front of ridge 38, for a purpose described below The upper edge of the rear opening of shroud 30 is comprised of an stiff upper mounting wall 42, identical to and directly above lower mounting wall 36. Parallel to upper mounting wall 42, and also spaced therefrom by the thickness of a rib 24 of the upper reinforcement 20U, is a slightly shorter flange 44, also forming a narrow trough. Integrally molded to the front of flange 44 is an inwardly sloped lead in ramp 46, which comprises the forwardmost surface of the upper mounting feature. Flange 44 and lead in ramp 46 are integrally molded to the upper edge of the rear opening of shroud 30 in such a way as to be flexible, either by virtue of the flexibility of flange 44, or of the joint that it makes with shroud 30, or both.

Still referring next to FIGS. 1 and 4, details of the rest of the heat exchanger mounting features are illustrated. A four sided opening at the front of shroud 30 is partially defined by two straight, parallel, co planar side edges 50, spaced apart by approximately the spacing of the condenser manifold tanks 26. The lower edge of the four sided opening is comprised of an integrally molded, relatively rigid, lower mounting trough 52, which has a length, width and depth sufficient to closely receive the condenser lower reinforcement 28L. Trough 52 is located just outboard of the plane of the side edges 50. Directly above lower trough 52 is an upper mounting trough 54, of comparable size, comprising the upper edge of the opening. Integrally molded to the front of upper trough 54 is a lead in ramp 56, comparable to the lead in ramp 46 on the other side. The front portion of upper trough 54 and its lead in ramp 56 are also molded to the upper edge of shroud 30 is such a way as to be flexible. As disclosed, a downwardly extending air dam 58 may be integrally molded to the front of lower trough 52.

Figure 5:
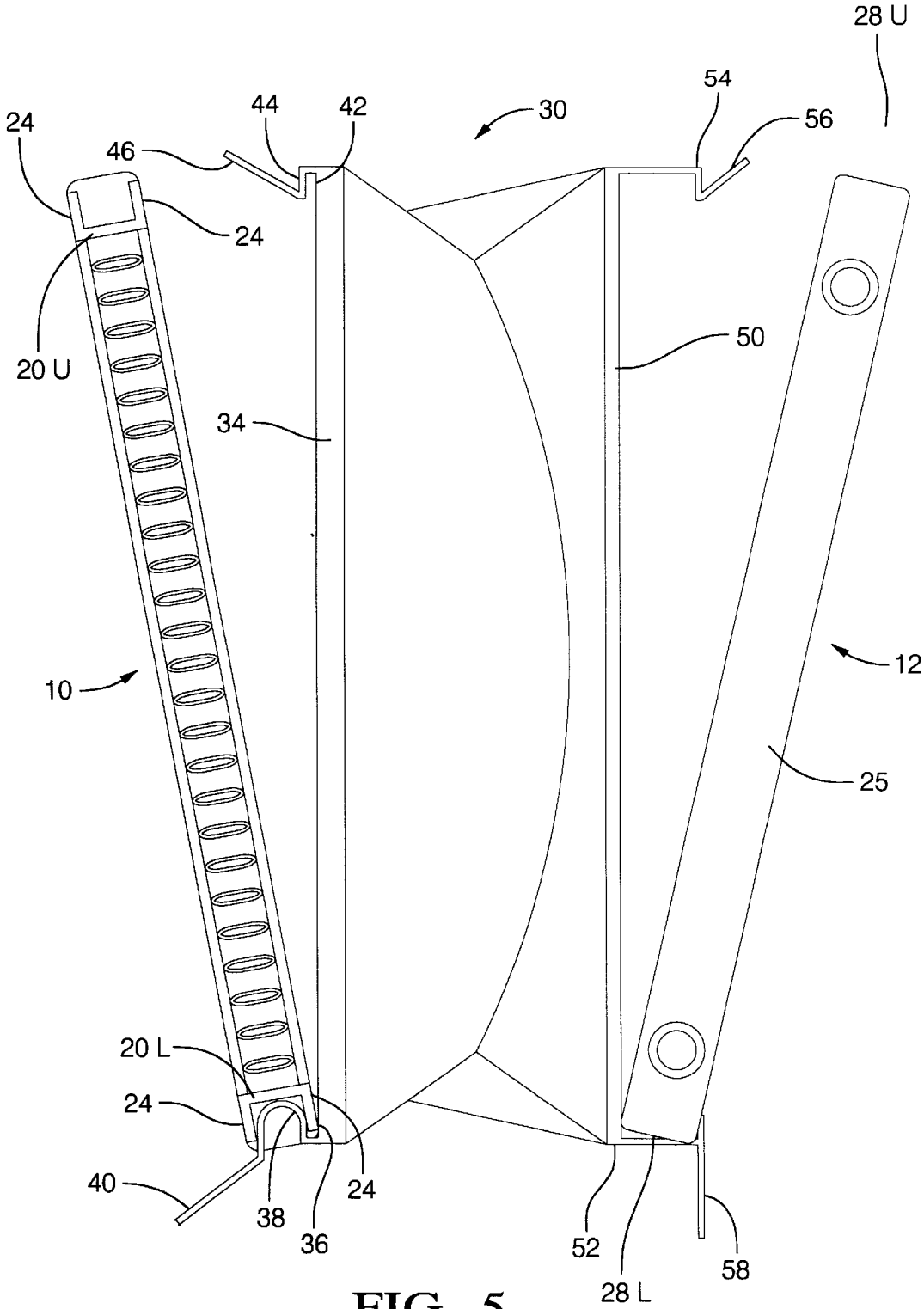
FIG. 5 is a schematic side view showing the bottom reinforcements of the heat exchangers seated in the module, with the top reinforcements beginning to be seated.
Figure 6:
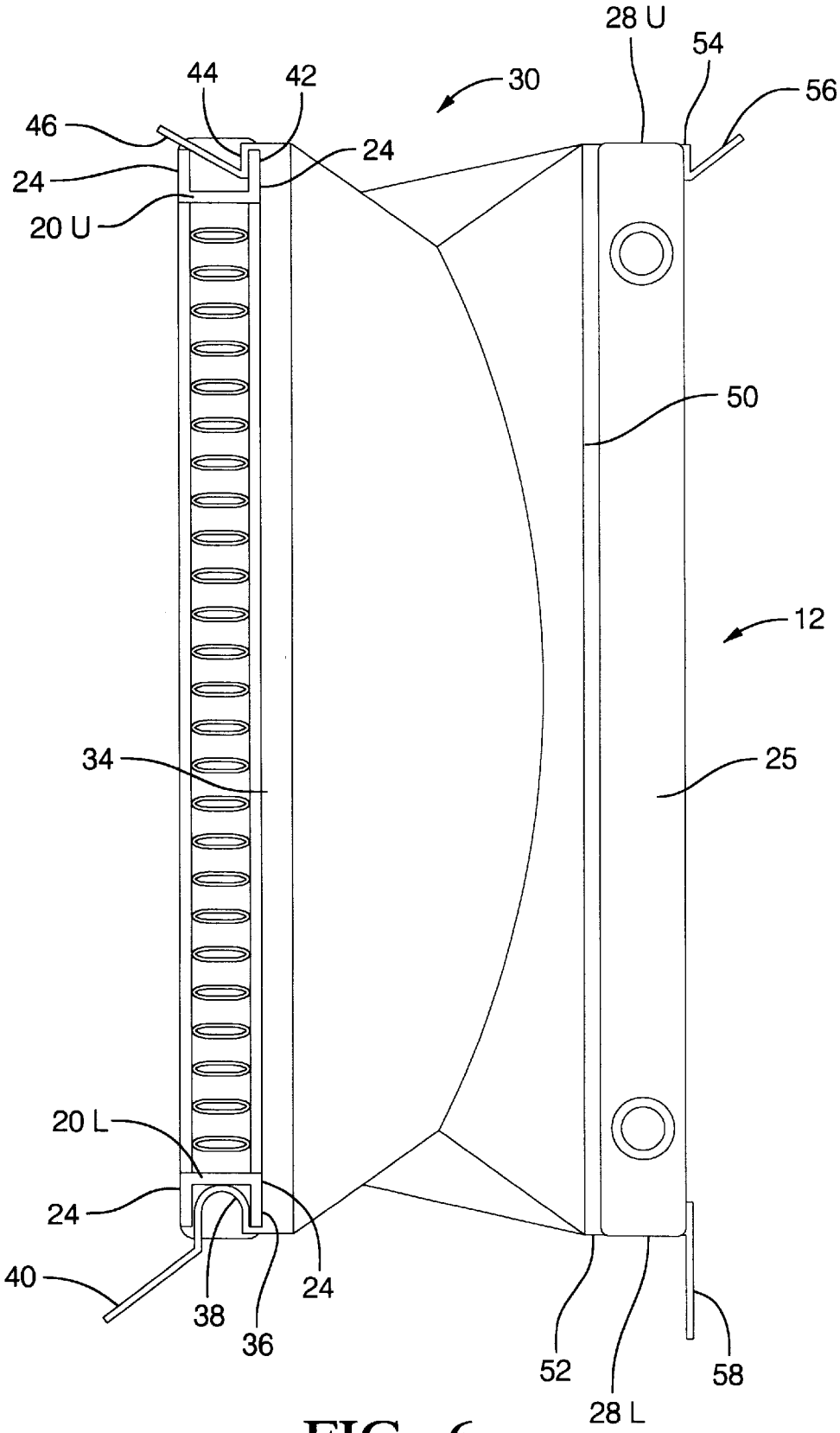
FIG. 6 is a view like FIG. 5, showing the heat exchangers fully installed.

Referring next to FIGS. 5 and 6, the installation of radiator 10 and condenser 12 is illustrated. Radiator 10 is installed by seating lower reinforcement 20L onto ridge 38, as shown in FIG. 5. Specifically, the rear rib 24 of lower reinforcement 20L is pushed into the thin trough formed by lower mounting wall 36 and ridge 38, where it makes a close fit, and is trapped and held. The inner surfaces of the radiator header plates 18 are located just to either side of the ends of ridge 38 and just outboard of the rear opening's side edges 34. Next, radiator 10 is swung upwardly and pressed inwardly, forcing the rear rib 24 of upper reinforcement 20U to slide along the lead in ramp 46. Ramp 46 is thereby pushed up, flexing flange 44 up as upper reinforcement 20U moves past the ramp 46 and is funneled in place to capture the rear rib 24 closely between upper mounting wall 42 and flange 44, where it is trapped and held. The facing inner surfaces of the radiator manifold header plates 18 are confined outboard of the side edges 34, and limited against any significant movement back and fourth. All four sides of the structural frame that comprises radiator 10 are thus either solidly held (upper and lower reinforcements 20L and 20U) or confined (header plates 18), so that the radiator 10 as a whole is solidly installed, without the need for any separate fasteners. In addition, the upper and lower mounting features, by virtue of being continuous along the reinforcements 20L and 20U, and the side edges 34, by virtue of being in close proximity to the facing inner surfaces of the header plates 18 and substantially flush to the face of the core, provide a good seal all around radiator 10. This assures that the air pulled in by the fans 32 is pushed efficiently through the core face.

Still referring to FIGS. 5 and 6, condenser 12 is installed to the front opening of shroud 30 in similar fashion, by seating its lower reinforcement 28L into the lower mounting trough 52, with the tanks 26 located outboard of the ends of trough 52 and the front opening's side edges 50. Then, condenser 12 is swung upwardly, sliding upper reinforcement 28U forcefully along lead in ramp 56, flexing it and the front portion of trough 54 upwardly until the upper reinforcement 28U snaps into upper trough 54, where it is captured, trapped and held. The tanks 26 are confined outboard of the front openings' side edges 50, and prevented from shifting back and forth significantly. Thus, as with radiator 10, all four sides of the condenser 12 are either trapped and held (upper and lower reinforcements 28L and 28U, or confined (tanks 26), solidly holding it in place without separate fasteners. And, as with radiator 10, the continuous confinement of the lower and upper reinforcements 28L and 28U within the lower and upper troughs 52 and 54, in conjunction with the close proximity of the tanks 26 to the side edges 50, provide good sealing of the face of condenser 12 against the front opening of shroud 30.

Figure 3:
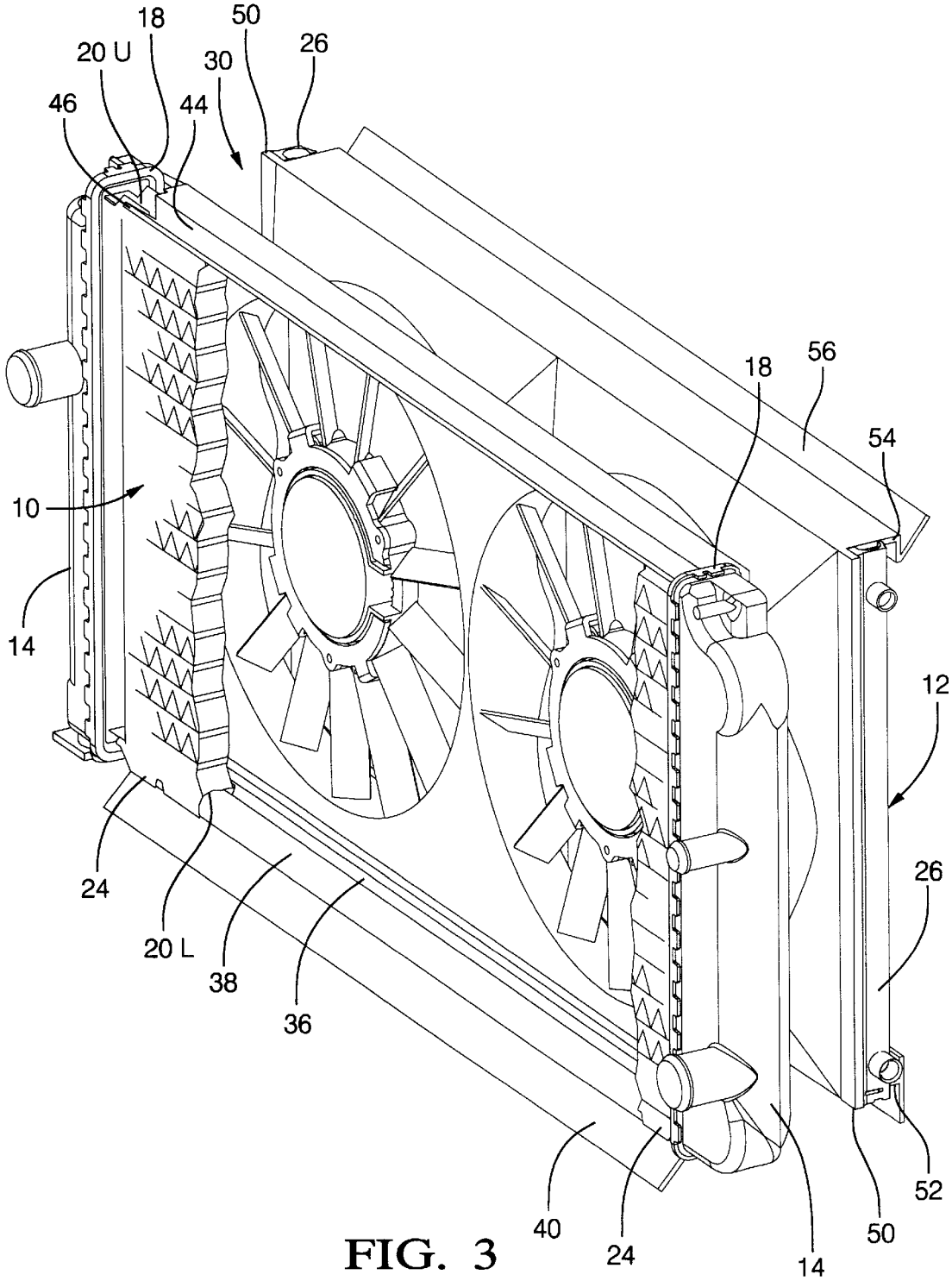
FIG. 3 shows the heat exchangers installed to the module.

Referring next to FIGS. 3 and 6, the completed module is illustrated. Efficient air flow through the module is assured not only by the good seal around the radiator 10 and condenser 12 noted above, but also by other features integrally molded to the shroud 30. Specifically, at the front of shroud 30 the air dam 58 integrally molded to the lower mounting trough 52 helps direct air through the condenser 12. The lead in ramp 56 on the upper trough 54 also helps to scoop air through condenser 12. At the rear of shroud 30, the air control blade 40 integrally molded to the front of ridge 38 helps direct hot air that has passed through radiator 10 away from circulating back around to the front of condenser 12. Shroud 30 is also well suited to accommodate differing depths of radiator 10. That is, since it is the rear ribs 24 alone of the lower and upper reinforcements 20L and 20U that are gripped and held, a deeper radiator core with greater spacing between the front and rear ribs 24 could still installed, without modification. Another advantage of the radiator mounting scheme is the elimination of separate vibration isolators. The continuous engagement of the upper and lower reinforcements 20L and 20U in and between mounting features molded of a material that has some inherent resilience, such as molded plastic, distributes shock loads and vibrations smoothly and efficiently.

Variations in the disclosed embodiment could be made. Only one heat exchanger could be mounted, to any framework or structure capable of providing one solid mounting feature for seating one core reinforcement of the heat exchanger, and a flexible mounting feature for flexibly receiving and capturing the other core reinforcement. There are usually two heat exchangers, however, and it is particularly advantageous if the basic module structure is the center mounted fan shroud with rear and front openings. The upper and lower mounting features could theoretically be reversed, or even embodied in the sides, in a case where the manifold tanks were located on the sides. It is simpler, of course, to seat the weight of the heat exchangers into the lower mounting features before swinging them up and into place. The upper mounting features for both condenser 12 and radiator 10 are disclosed as being continuous, although they could be discrete, consisting of a plurality of shorter lengths, integral clips, in effect, which had a similar cross sectional size and shape. Especially when the material from which they and shroud 30 were molded was quite stiff, such shorter, discrete mounting features could easily provide enough holding power, and present less resistance to snapping the heat exchangers in place. Therefore, it will be understood that it is not intended to limit the invention to just the embodiment disclosed.

What is claimed is:

1. A vehicle heat exchanger module, comprising, at least one heat exchanger having first and second, parallel, generally channel shaped core reinforcements of predetermined size and shape, a module structure having at least one opening, one side of which opening comprises a first mounting feature into which said first core reinforcement is closely seated, and an opposed side of which opening comprises a second mounting feature into which said second core reinforcement is closely seated, said second mounting feature further comprising a forwardmost, integrally formed flexible surface leading into said second mounting feature that is engageable with said second core reinforcement to flex past said second core reinforcement as said second core reinforcement is seated in said second mounting feature to resiliently capture said second core reinforcement.

2. A vehicle heat exchanger module according to claim 1, in which said module structure comprises front and rear openings, each having first and second mounting features, and in which said heat exchangers are a condenser installed in said front opening and a radiator installed in said rear opening.

3. A vehicle heat exchanger module according to claim 2, in which said module structure is a center mounted fan shroud.

4. A vehicle heat exchanger module according to claim 1, in which said first and second core reinforcements comprise upper and lower sides of said heat exchanger.

5. A vehicle heat exchanger module according to claim 1, in which said first and second mounting features are continuous along said respective core reinforcements.

* * * * *